US006886581B2

(12) United States Patent
Harniet

(10) Patent No.: US 6,886,581 B2
(45) Date of Patent: May 3, 2005

(54) GAS VALVE WITH A THERMOELECTRIC SECURITY DEVICE

(76) Inventor: Uwe Harniet, 1466 W. Francis Ave., Ontario, CA (US) 91762-6016

( * ) Notice: Subject to any disclaimer, the term of this patent is extended or adjusted under 35 U.S.C. 154(b) by 0 days.

(21) Appl. No.: 10/703,746

(22) Filed: Nov. 7, 2003

(65) Prior Publication Data

US 2004/0094199 A1 May 20, 2004

Related U.S. Application Data

(60) Provisional application No. 60/425,779, filed on Nov. 12, 2002.

(51) Int. Cl.[7] ..... F23D 14/72
(52) U.S. Cl. ..... 137/66
(58) Field of Search ..... 137/65, 66, 614.11; 251/96, 111; 431/54, 78, 79, 80

(56) References Cited

U.S. PATENT DOCUMENTS 2,151,541 A * 3/1939 Waddell ..... 236/99 R
2,153,886 A * 4/1939 Grayson ..... 236/15 A
2,687,275 A * 8/1954 Huff ..... 251/96
2,718,918 A * 9/1955 Marvin ..... 137/66
3,012,584 A * 12/1961 Carlson et al. ..... 251/96
4,437,830 A * 3/1984 Harris et al. ..... 431/54
4,442,853 A 4/1984 Gort
4,543,974 A 10/1985 Dietiker et al.
5,094,259 A 3/1992 Hsu
5,988,215 A 11/1999 Martin et al.
6,213,152 B1 4/2001 Ayastuy
6,234,189 B1 * 5/2001 Koch ..... 137/66

* cited by examiner

*Primary Examiner*—George L. Walton
(74) *Attorney, Agent, or Firm*—Lewis M. Brande; Thomas A. McCleary; Brande and McCleary

(57) ABSTRACT

This invention reveals an improved gas valve with a thermoelectric security device that has a shortened distance from the gas inlet to the front of an appliance, enabling the overall size of the appliance to be smaller than normal for this type of device.

The current invention achieves this goal by reversing the gas inlet and outlet and hence the gas flow through the gas valve.

2 Claims, 3 Drawing Sheets

NEW CONSRUCTION

NEW CONSRUCTION

3b

OPEN POSITION

3a

CLOSED POSITION

GAS VALVE WITH A THERMOELECTRIC SECURITY DEVICE

This application claims the benefit of Provisional Application No. 60/425,779 filed Nov. 12, 2002.

FIELD OF THE INVENTION

The present invention relates to the field of gas valves. More specifically the present invention relates to the field of gas valves that are commonly used in homes and control the flow of gas to standard cooking appliances.

BACKGROUND OF THE INVENTION

Modernly, it is common practice among suppliers of stoves for commercial and home use to provide the cooking unit with a safety shutoff system that uses a thermoelectric solenoid that interrupts the flow of flammable gas when the flame has been extinguished. This gas valve is common in the industry, and is very user friendly in its operation. The user presses the control knob in, which overrides the solenoid spring allowing the gas to flow to the burner, at which time the flammable gas is ignited causing an emf current flow that energizes the solenoid, and keeps the gas supply flowing. When the flame is extinguished, the current stops, and the solenoid de-energizes, cutting off the flow of flammable gas.

The current designs of gas valves force the flammable gas to flow from the rear of the valve towards the front of the valve, which has the consequence of lengthening the control know, and therefore the offset to the front of the appliance.

Another well-known shortcoming of these valves, hereinafter known as standard valves, is that they are frequently awkward to install, because of the locating dimensions of the inlet and the exhaust. In commonly known constructions, either the distance from the gas-conducting valve assembly tube to the front plate of an appliance is relatively large or these constructions are built relatively high.

DESCRIPTION OF THE PRIOR ART

U.S. Pat. No. 6,234,189 B1 by Koch, discloses a "Gas Valve with Thermoelectric Safety Shutoff". The standard construction is disclosed and described. The major difference is that the inlet, and inlet attach features are towards the rear of the gas valve, and the exhaust is more towards the front (bottom located) of the gas valve. Although the basic design is similar, the resultant size of the valve is increased. Additionally and more specifically, the flow of the flammable gas of the described patent is reversed from the present invention.

OBJECTS OF THE INVENTION

It is a present object of the invention to provide an improved gas valve the overcomes the existing disadvantages of the current designs, by shortening the distance from the inlet to the front of the appliance, therefore shrinking the overall size of the appliance.

SUMMARY OF THE INVENTION

The following description is provided to enable a person skilled in the art to make and use the invention and sets forth the best modes contemplated by the inventor for carrying out his invention. Various modifications, however, will be readily apparent to those skilled in the art, since the generic principles of the present invention have been defined herein specifically to provide for an improved adjustable gas pressure regulator.

The task is to construct a gas valve incorporating thermoelectric security device, in which both of the previously described large locating dimensions must be reduced.

The standard valves have the inlet, and hence the gas flowing from the area of the thermoelectric security device, which has a magnetic insert (solenoid) that is open when the flame is ignited. When the valve is open, the gas flows axially into the valve plug, through the valve plug, and then through either a hole drilled at a 90° angle to the valve plug or a slot. The gas will then flow into the outlet of the valve. The outlet, or exhaust directs the gas to flow into a gas line and then to a burner attached to the cooking appliance.

The present invention reverses the inlet and outlet and hence the direction of the gas flow through the gas valve. The gas flow path then enters the inlet of the valve and is directed into the valve plug and when the magnet valve (or solenoid) is in the open position, the gas passes through the axially located hole in the valve plug through the valve plug, and then through the gas outlet of the valve body.

DESCRIPTION OF THE DRAWINGS

FIG. 2*a* shows a valve in the closed position, while FIG. 2*b* shows the same valve in the open position.

FIG. 3*a* shows an open position, FIG. 3*b* shows a closed position

DETAILED DESCRIPTION

Figure 1:
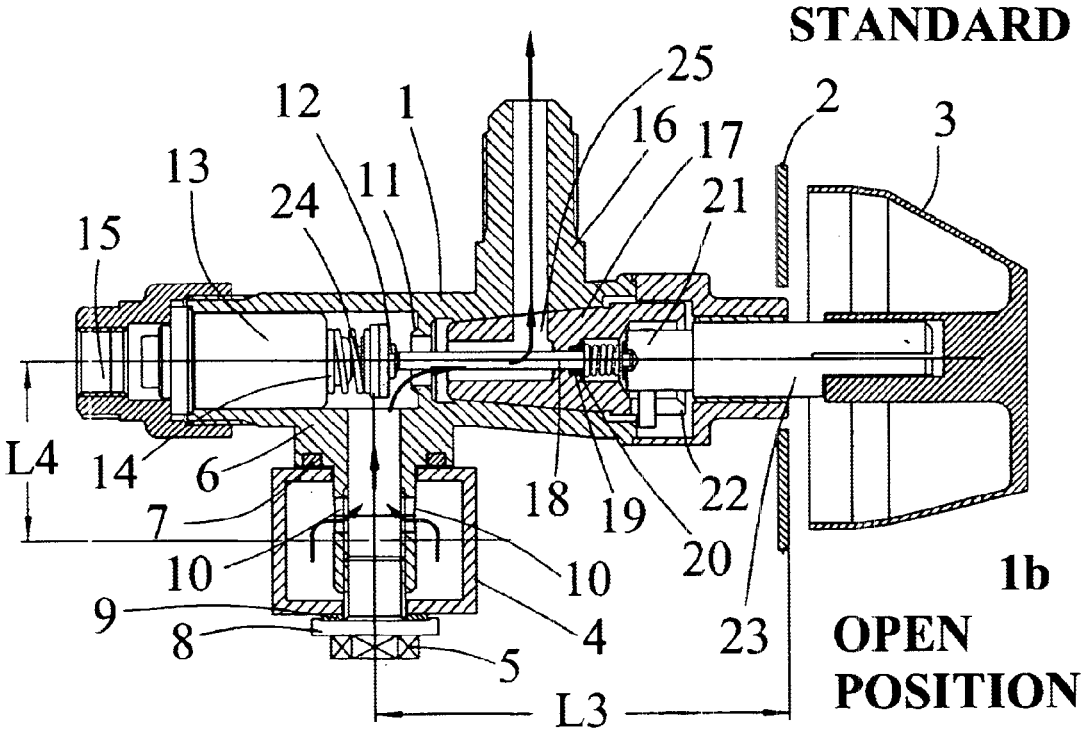
FIG. 1*a* shows a standard construction, where the gas valve is in the closed position.
FIG. 1*b* shows the same valve as described in FIG. 1*a* in its open position.
Figure 1:
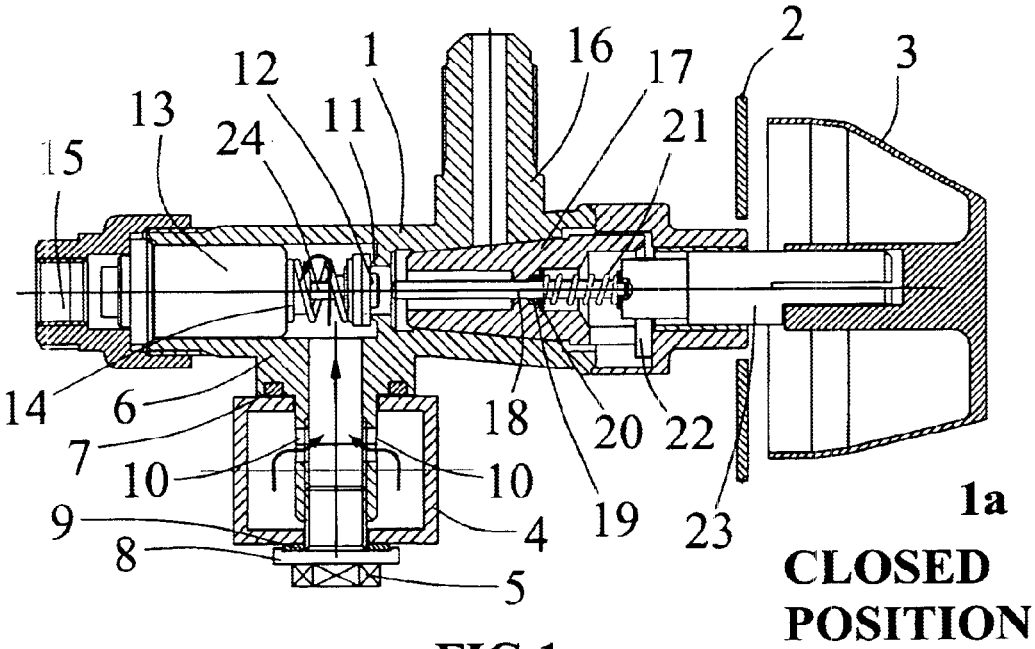
Figure 2:
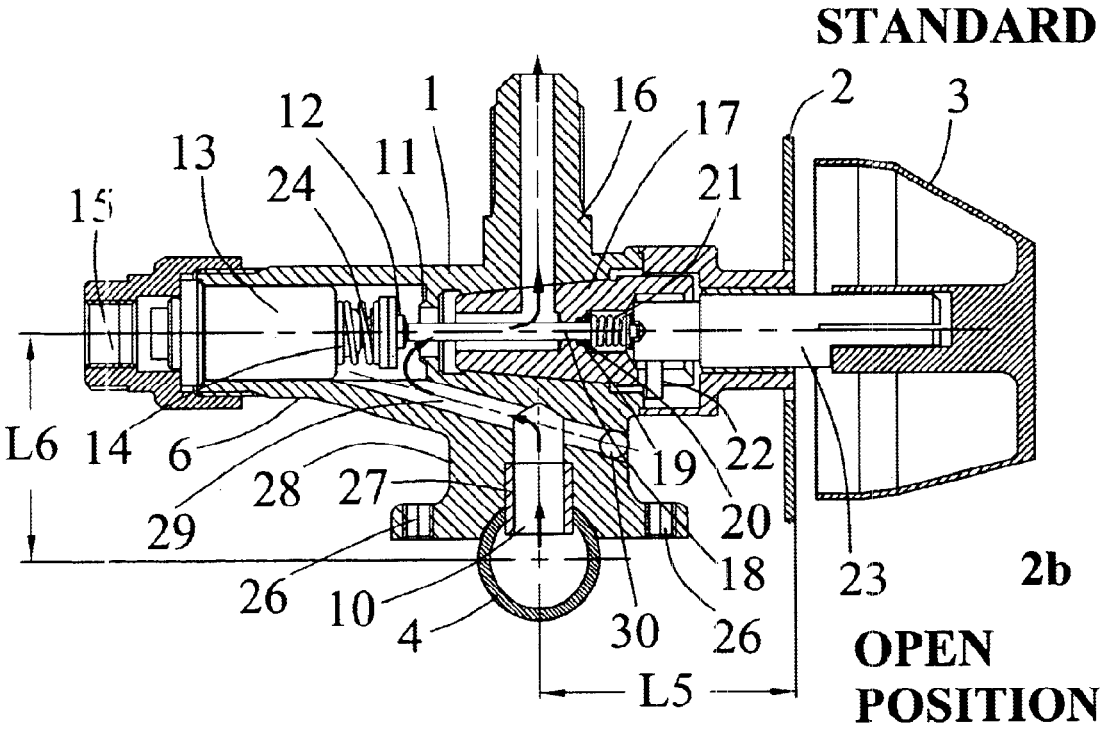
FIG. 2 shows a gas valve in which the distance from gas inlet of the valve to the valve plate is small, but the installation height is relatively large.
Figure 2:
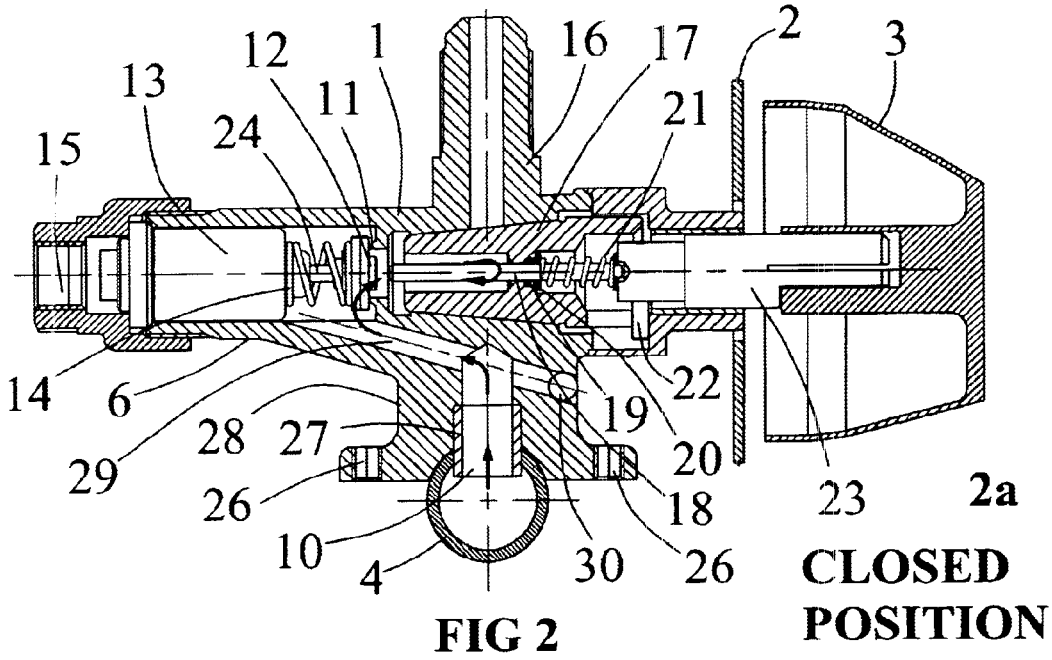
Figure 3:
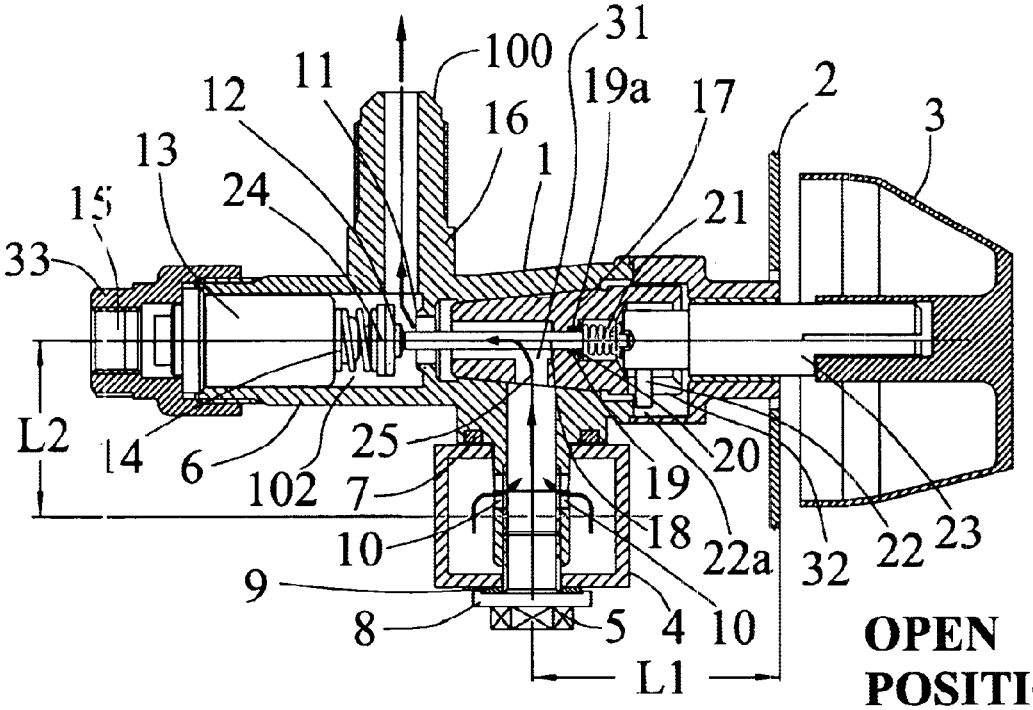
FIG. 3 shows the new development of a gas valve.
Figure 3:
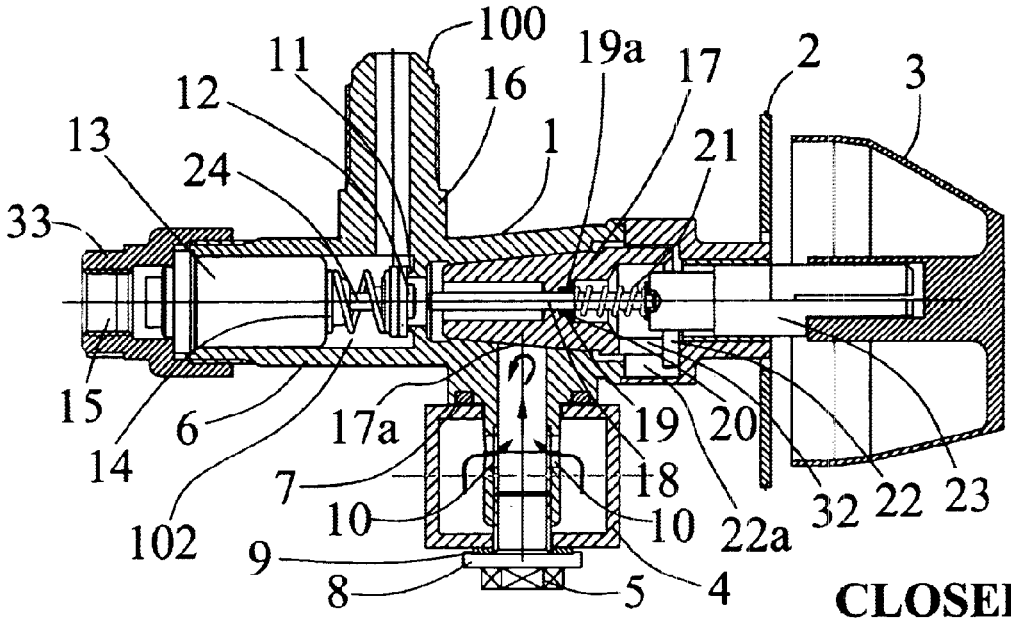

With respect to FIG. 3, the gas valve body (1) is shown being provided with a gas inlet (10) and a gas outlet (16). The in flowing gas flow is restricted by the mantle surface (17*a*) of the valve plug (17). The gas valve body (1) is connected to the gas conducting gas supply tube (4), with elastic washers (7, 9), and held in place by a screw (5) that is firmly threaded into the gas inlet (10) of the gas valve body (1). FIG. 3*a* shows the gas valve assembly (100) in a closed position.

The gas valve body (1) has a receiver hole (102) bored into the gas valve body (1) for the magnet insert (13). The receiver hole (102) communicates with the gas outlet (16). The magnet insert (13) has a pressure spring (14) which biases a valve disk (12) against a valve seat (11) located in the gas valve body (1). The valve disk (12) is slidably mounted on a spindle (24). The gas valve plug (17) has an axial spindle (18) that is mounted in the gas valve plug (17). The spindle (18) is assembled with a pressure plate (20) that contains an O-ring(19). The O-ring (19) seals against the inner offset hole (19*a*) of the gas valve plug (17), preventing leakage of gas through the inner offset hole (19*a*). The axial spindle (18) is generally connected to the valve spindle (23) on the opposite side. A pressure plate (20) is biased against the O-ring (19), by a pressure spring (21), thereby making a gas-tight seal in the valve plug (17). The pressure spring (21) is assembled between the pressure plate (20) and the valve spindle (23). The magnetic insert (13), the pressure spring (14), and the valve disk (12) comprise a magnetic solenoid, common in the art. The solenoid is energized by current generated by the heat of combustion of the flammable gas (thermocurrent).

The valve spindle (23) is assembled with a driver pin (22) that drives the valve plug (17). The valve plug (17) is provided with a slot (31). When the slot (31) is rotated from the closed position to the open position, the gas inlet (10) will communicate with the slot (31) allowing the gas to pass through. This driver pin (22), in turn, meshes with an indentation **(22*a*) of the valve flange (32) and thus prevents gas entering the gas valve plug (17) unless a gas valve knob (3) is axially pressed in at the same time the gas valve plug (17) is rotated to an orientation where the gas can enter. The activation is both axial and as provided by the indentation in the valve flange (32) and is activated by the gas valve knob (3) that is attached to the valve spindle (23)** located in front of the front plate of the cooking appliance.

If the valve plate (24) is opened by pressing in the gas valve knob (3), the gas still cannot flow through the valve seat (11), if the gas valve knob (3) is not also rotated, since the gas valve plug (17) still remains in a closed position, orientated away from a gas inlet hole (25). The gas inlet hole (25) is bored at 90° to the central axis of the gas valve body (1). Only after simultaneous pushing in and rotating of the valve spindle (23) by means of the gas valve knob (3), can gas flow through the gas valve assembly (100) as shown in FIG. **3*b***.

The valve spindle (23) is held in an open position by turning the valve plug (17) in conjunction with a driver pin (22), provided that the thermocouple (not shown) which is mounted in the hole (15) of the assembly nut (33) has generated sufficient thermocurrent to hold the magnet (13) (solenoid) in an open (energized) position. Only after an interval of about 5 seconds can the gas valve knob (3) be released and the valve plate (24) of the magnet insert remain in the open position.

If the flame of the burner goes out and the thermocouple cools off, the conduction of thermocurrent is interrupted, and the valve plate (24) in the magnet insert (13) is pressed against the seat (11) of the gas valve body (1) by the pressure spring (14), so that despite the open position of the valve plug (17), no additional gas can penetrate through to the gas valve outlet (15), even though the gas valve knob (3) still indicates that the gas valve assembly (100) is in an open position.

What is claimed is:

1. An Improved Gas Valve with a Thermo-Electric Security Device, comprising:

a. a gas valve, said gas valve having a gas inlet and a gas outlet, said gas inlet being dimensionally closer to a gas valve knob than said gas outlet to have the adaptability to be utilized with different gas intet valve types, b. said gas valve further having a gas valve body, said gas valve body having a gas valve plug, said gas valve plug being positioned within said gas valve body and having a valve seat defined therein, said valve seat being positioned in proximity to said gas outlet, said gas valve further having a receiver hole defined therein, said receiver hole communicating with said gas outlet, said gas valve plug having means to allow communication between said gas inlet and said gas outlet when said gas valve plug is rotated by a valve spindle, said valve spindle being attached to said gas valve knob;

c. said valve spindle has a driver pin attached, said driver pin driving said valve plug so that flammable gas is not permitted to enter said gas valve plug unless said gas valve knob is axially pressed in and said gas valve plug is rotated coincidentally to an orientation allowing communication between said gas valve plug and said gas inlet allowing flammable gas to thereby enter said gas valve plug;

d. a valve disc, said valve disc being slidably mounted on a spindle, said spindle being attached to a magnet insert, said valve disk being biased against said gas valve body and being positioned in said valve seat preventing flammable gas to thereby exit, and e. a thermo-electric safety device means, where said thermo-electric safety device means generates sufficient thermocurrent to cause said magnet insert to maintain said valve disc in an open position, allowing flammable gas to flow through said gas valve plug and through said gas outlet, wherein said inlet being dimensionally closer to said gas valve knob than said gas outlet to prevent gas from entering said thermo-electric safety device means when it is closed and said valve plug is still in an open position.

2. The gas valve, according to claim 1, in which the flammable gas inside the gas valve plug can only flow to the valve seat of the magnet insert when the gas valve is in the open position, while the valve seat of the magnet insert is held in a closed position by the absence of thermocurrent.

* * * * *